US008876990B2

(12) United States Patent
Schuh et al.

(10) Patent No.: US 8,876,990 B2
(45) Date of Patent: Nov. 4, 2014

(54) THERMO-MECHANICAL PROCESS TO ENHANCE THE QUALITY OF GRAIN BOUNDARY NETWORKS

(75) Inventors: Christopher A. Schuh, Marlborough, MA (US); Koichi Kita, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 445 days.

(21) Appl. No.: 12/544,568

(22) Filed: Aug. 20, 2009

(65) Prior Publication Data

US 2011/0041964 A1 Feb. 24, 2011

(51) Int. Cl.
*C21D 9/00* (2006.01)

(52) U.S. Cl.
USPC ..... 148/559; 148/525; 148/592

(58) Field of Classification Search
USPC ..... 148/525, 559, 592
IPC ..... C21D 7/06,8/00
See application file for complete search history.

(56) References Cited

U.S. PATENT DOCUMENTS

| | | | | |
|---|---|---|---|---|
| 2,897,107 | A | | 7/1959 | Carlen et al. |
| 3,989,548 | A | | 11/1976 | Morris |
| 4,066,475 | A | | 1/1978 | Chia |
| 4,110,132 | A | | 8/1978 | Parikh et al. |
| 4,238,249 | A | | 12/1980 | Ruchel |
| 4,305,763 | A | | 12/1981 | Quist et al. |
| 5,039,355 | A | | 8/1991 | Daumas et al. |
| 5,119,660 | A | | 6/1992 | Koppinen et al. |
| RE34,008 | E | | 7/1992 | Quist et al. |
| 5,651,839 | A | | 7/1997 | Rauf |
| 5,702,543 | A | * | 12/1997 | Palumbo ..... 148/592 |
| 5,817,193 | A | | 10/1998 | Palumbo |
| 6,001,461 | A | | 12/1999 | Toyoda et al. |
| 6,056,835 | A | | 5/2000 | Miyake et al. |
| 6,086,691 | A | | 7/2000 | Lehockey et al. |
| 6,129,795 | A | | 10/2000 | Lehockey et al. |
| 6,197,134 | B1 | | 3/2001 | Kanzaki et al. |
| 6,342,110 | B1 | | 1/2002 | Palumbo |
| 6,344,097 | B1 | | 2/2002 | Limoges et al. |
| 6,348,108 | B1 | | 2/2002 | Yusa et al. |
| 6,406,566 | B1 | | 6/2002 | Ishida et al. |
| 6,455,166 | B1 | | 9/2002 | Truchan et al. |
| 6,592,686 | B2 | | 7/2003 | Palumbo |

(Continued)

FOREIGN PATENT DOCUMENTS

| | | |
|---|---|---|
| EP | 2194149 | 6/2010 |
| EP | 2377959 | 10/2011 |

(Continued)

OTHER PUBLICATIONS

Bedrossian, et al., "Observation of Localized Corrosion of Ni-Based Alloys Using Coupled Orientation Imaging Microscopy and Atomic Force Microscopy," *MRS Proc.* 1999.

(Continued)

*Primary Examiner* — Weiping Zhu
(74) *Attorney, Agent, or Firm* — Wolf, Greenfield & Sacks, P.C.

(57) ABSTRACT

Methods to enhance the quality of grain boundary networks are described. The process can result in the production of a metal including a relatively large fraction of special grain boundaries (e.g., a fraction of special grain boundaries of at least about 55%).

28 Claims, 3 Drawing Sheets

(56) References Cited

U.S. PATENT DOCUMENTS

| | | | | |
|---|---|---|---|---|
| 6,610,154 | B2 * | 8/2003 | Limoges et al. | 148/525 |
| 6,699,337 | B2 | 3/2004 | Hatakeyama et al. | |
| 6,743,308 | B2 | 6/2004 | Tanaka et al. | |
| 6,749,696 | B2 | 6/2004 | Freier et al. | |
| 6,783,611 | B2 | 8/2004 | Yajima et al. | |
| 6,802,917 | B1 | 10/2004 | Tomantschger et al. | |
| 6,893,510 | B2 | 5/2005 | Fortunati et al. | |
| 7,285,174 | B2 | 10/2007 | Eickemeyer et al. | |
| 7,476,281 | B2 | 1/2009 | Fluekiger et al. | |
| 2004/0003878 | A1 | 1/2004 | Izumi et al. | |
| 2004/0069377 | A1 | 4/2004 | Fortunati et al. | |
| 2008/0035247 | A1 | 2/2008 | Fujita et al. | |
| 2008/0099110 | A1 | 5/2008 | Muroga et al. | |
| 2008/0277032 | A1 | 11/2008 | Tomioka et al. | |
| 2010/0243112 | A1 | 9/2010 | Wright et al. | |
| 2011/0240180 | A1 | 10/2011 | Gao et al. | |
| 2012/0192997 | A1 | 8/2012 | Yaguchi et al. | |

FOREIGN PATENT DOCUMENTS

| | | | |
|---|---|---|---|
| JP | 11-269611 | A | 10/1999 |
| JP | 2002285267 | B2 | 10/2002 |
| JP | 2002356728 | A | 12/2002 |
| JP | 2003253401 | A2 | 9/2003 |
| JP | 2005029857 | B2 | 2/2005 |
| JP | 2006-152392 | A | 6/2006 |
| JP | 2006176837 | A2 | 7/2006 |
| JP | 2007107038 | A | 4/2007 |
| JP | 2007191781 | A | 8/2007 |
| JP | 2007239042 | A | 9/2007 |
| JP | 2008088558 | A1 | 4/2008 |
| JP | 2008-106356 | A | 5/2008 |
| JP | 2011219833 | | 11/2011 |
| WO | WO 2007072752 | A1 | 6/2007 |
| WO | WO 2012/004868 | | 1/2012 |
| WO | WO 2012/106414 | | 8/2012 |

OTHER PUBLICATIONS

Coleman, M., et al.,"Changes in Interface Parameters and Tensile Properties in Copper as a Consequence of Iterative Processing," *Metallurgical and Materials Transactions*, 39A, Sep. 2008, pp. 2175-2183.

Davies, H., et al., "Triple jundtion distribution profiles as assessed by electron backscatter diffraction," *Journal of Materials Science*, 37, 2002, pp. 4203-4209.

King, W.E., et al., "Toward Optimization of the Grain Boundary Character Distribution in OFE Copper," Scripta Materialla, 38(3), 1998, pp. 449-455.

Kumar, M., et al., "Modifications to the Microstructural Topology in F.C.C. Materials Through Thermomechanical Processing," *Acta Materialla*, 48, 2000, pp. 2081-2091.

Lin, P., et al., "Influence of Grain Boundary Character Distribution on Sensitization and Intergranular Corrosion of Alloy 600," *Scripta Metallurgical et Materialla*, 33, 1995, pp. 1387-1392.

Randle, V., et al., "Evolution of Microstructure and Properties in Alpha-Brass after Iterative Processing," *Metallurgical and Materials Transactions A*, 33A, 2002, pp. 1853-1857.

Dieter et al., Handbook of Workability and Process Design. Oct. 1, 2003;148-9.

* cited by examiner

THERMO-MECHANICAL PROCESS TO ENHANCE THE QUALITY OF GRAIN BOUNDARY NETWORKS

FIELD OF INVENTION

The present invention relates generally to methods for processing metals to enhance the quality of grain boundary networks.

BACKGROUND

Grain Boundary Engineering (GBE) refers to a family of techniques involving the processing, evaluation, and classification of grain boundaries within polycrystalline materials. Generally speaking, grain boundaries are less energetically stable than the interior regions of crystal grains. The level of instability depends upon the grain boundary type (i.e., crystallographic type), of which many exist. Certain types of grain boundaries, referred to in the art as "special" grain boundaries, exhibit improved properties compared to "general" grain boundaries. GBE may be used to manipulate or optimize the morphology and network of grain boundaries to produce a larger fraction of special grain boundaries, and hence, desirable bulk properties. The formation of annealing twins, which is a common phenomenon in various kinds of FCC metals and alloys, is thought to be a key mechanism in increasing the fraction of special boundaries.

SUMMARY OF THE INVENTION

Methods for processing metals to enhance the quality of grain boundary networks are provided.

In one aspect, a method of processing a metal is provided. The method includes the steps of, while maintaining the metal at a temperature expressed in Kelvins above about one-third of the melting point of the metal expressed in Kelvins, applying a force to strain the metal over a first period of time and reducing the applied force over a second period of time subsequent to the first period of time. The metal is processed to have a special grain boundary fraction of at least about 55%.

Other advantages and novel features of the present invention will become apparent from the following detailed description of various non-limiting embodiments of the invention.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
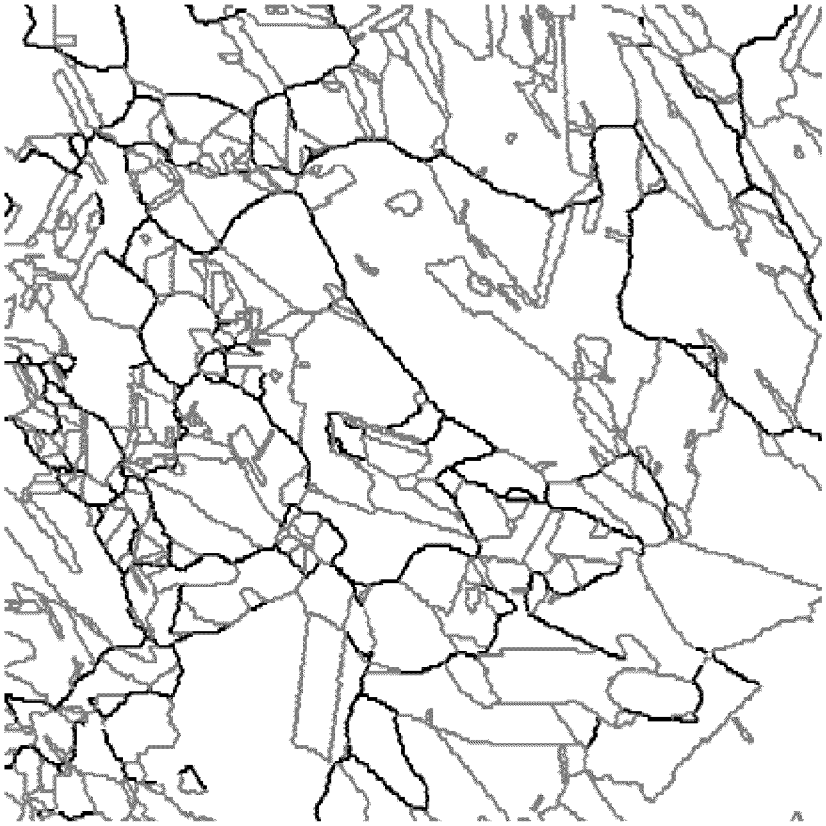
FIG. 1 includes an exemplary image outlining special grain boundaries in Sample 1 of Example 1.

Methods to enhance the quality of grain boundary networks of a metal are described. In one set of embodiments, a metal is maintained at an elevated temperature (e.g., sufficient to anneal the metal) while a force is applied to strain the metal over a first period of time. The force may be reduced (e.g., so that the metal is no longer strained) and remain so over a second period of time while maintaining the metal above the elevated temperature. The force application and force reduction steps may be repeated for one or more cycles. The process can result in the production of a metal including a relatively large fraction of special grain boundaries (e.g., a fraction of special grain boundaries of at least about 55%).

Advantageously, the force application and force reduction steps may both be performed at an elevated temperature, eliminating the need to substantially heat and cool the processed metal between processing steps. This may result in significant energy and time savings, and can render the process industrially feasible.

The methods described herein may be used to produce metals with an increased fraction of special grain boundaries and hence, a variety of desirable properties. For example, metals with high fractions of special grain boundaries may dissolve uniformly in solvents. Such metals may find particular use as anode materials, for example, in electrodeposition systems. In addition, metals with high fractions of special grain boundaries may exhibit relatively high mechanical strength and/or weldability. The metals may also exhibit high resistance to softening, hot cracking, stress-corrosion cracking, creep, electromigration, and/or corrosion.

The process can include the step of maintaining the metal at a temperature above a selected value. For example, the metal can be maintained at a temperature of above about one-third of its melting point (wherein the temperature and the melting point are expressed in Kelvins). For many metals, one-third of the melting point is above ambient temperature. In some instances, the metal can be maintained at a temperature of above about 300° C. (573 K), above about 400° C. (673 K), above about 500° C. (773 K), above about 600° C. (873 K), above about 700° C. (973 K), above about 800° C. (1073 K), or above about 900° C. (1173 K). In some cases, the metal may be maintained at a temperature of above about 0.33 $T_m$, above about 0.4 $T_m$, above about 0.5 $T_m$, above about 0.6 $T_m$, or above about 0.7 $T_m$ (wherein the temperature and the melting point, $T_m$, are expressed in Kelvins). In some embodiments, maintaining a metal above this temperature may comprise applying energy (e.g., in the form of heat) to the metal to ensure that it does not cool below the temperature. In some instances, a substantially uniform temperature may be maintained throughout the bulk of the material. The temperature of a metal described herein may be maintained, for example, using a furnace, via resistive heating, induction heating, gas burners or by any other suitable method known in the art.

The temperature of the metal may be maintained within a range. The range may be absolute in some cases (e.g., between about 300° C. and about 1000° C., or between about 400° C. and about 700° C.). In some embodiments, the range may be measured as a fraction of the melting point (e.g., between about 0.33 $T_m$ and about 0.95 $T_m$, between about 0.4 $T_m$ and about 0.75 $T_m$, or between about 0.45 $T_m$ and about 0.6 $T_m$, (wherein the temperature and the melting point are expressed in Kelvins)).

In some embodiments, the process involves heating the metal to a temperature above the selected value at which the metal is maintained (e.g., above the values noted above). The heating step may occur prior to the above-described step of maintaining the metal above the selected value. The metal may be heated, in some cases, above about 300° C. (573 K), above about 400° C. (673 K), above about 500° C. (773 K), above about 600° C. (873 K), above about 700° C. (973 K), above about 800° C. (1073 K), or above about 900° C. (1173 K). In some cases, the metal may be heated above a temperature of about 0.33 $T_m$, above about 0.4 $T_m$, above about 0.5 $T_m$, above about 0.6 $T_m$, above about 0.7 $T_m$, or higher, where $T_m$ is measured as an absolute temperature in Kelvins.

Heating the metal may also comprise heating the metal to a temperature within a range. The range may be absolute in some cases (e.g., between about 300° C. and about 1000° C., or between about 400° C. and about 700° C.). In some embodiments, the range may be measured as a fraction of the melting point (e.g., between about 0.33 $T_m$ and about 0.95 $T_m$, between about 0.4 $T_m$ and about 0.75 $T_m$, or between about 0.45 $T_m$ and about 0.6 $T_m$, wherein the temperature and the melting point are expressed in Kelvins).

In some preferred embodiments, the metal is heated (and, in some cases, also maintained) above a temperature suitable to anneal the metal. Such temperatures may include those described above. Annealing generally involves heat treating a metal to alter its microstructure, resulting, in some embodiments, in the recrystallization of at least a portion (or, in some cases, substantially all) of the annealed metal.

The metal may be heated in any suitable atmosphere. For example, in some cases, the metal may be exposed to ambient air (i.e., about 80% nitrogen and about 20% oxygen) while it is annealed. In some embodiments, the metal may be exposed to an inert atmosphere while being annealed (e.g., helium, argon, nitrogen, etc.). In some embodiments a working gas environment or reducing atmosphere would be desirable. For example, in some embodiments, the atmosphere may consist of nitrogen with a small amount (e.g., up to about 3%) of hydrogen, which may react with any undesired oxygen in the atmosphere.

While maintaining the metal at an elevated temperature (e.g., above a temperature or within a temperature range), a force may be applied to the metal. The applied force may be applied to plastically strain the metal, in some cases, over a period of time. Plastically straining a metal may comprise any process which alters the shape of the metal, i.e., plastically deforms the metal. In some embodiments, straining may comprise compressing the metal on one or more axes (e.g., forging the metal), stretching the metal, rolling the metal, extruding the metal, stamping the metal, drawing, deep-drawing, or blanking the metal, or any other method of deformation or shape forming known in the art.

When the applied force is along one axis, the extent of change in the dimension of the metal (e.g., along the length of the metal) along that axis, divided by the original dimension of the metal along that axis, is referred to as the engineering strain. Engineering strain is expressed as a percentage of the change in dimension along that axis as compared to the original dimension along that axis. In some cases, the applied force produces an engineering strain of at least about 3%, at least about 5%, at least about 10%, at least about 25%, at least about 50%, at least about 80%, at least about 95%, at least about 99%, or at least about 99.8%. Applying a force to strain a metal may also produce an engineering strain between about 3% and about 99.8%, or between about 50% and about 95%.

In some cases, the strain may be expressed as a true strain. True strain is also known to those of ordinary skill in the art of shape forming and deforming. When the force deforming a metal is applied along one axis, the true strain refers to the extent of change in the dimension of the metal, divided by the instantaneous dimension of the metal along that axis. True strain can also be expressed as a percentage change in dimension as compared with the instantaneous dimension along the axis. In some embodiments, the applied force may produce a true strain of at least about 3%, at least about 4.8%, at least about 9.5%, at least about 22.3%, at least about 40%, at least about 58%, or at least about 70%. Applying a force to strain a metal may also produce a true strain between about 3% and about 70%, or between about 40% and about 58%.

In some cases, when the force applied is complex and/or multiaxial, the change in dimension along one axis may not completely describe the resulting strain. In these cases, the von Mises strain, which is known to those of ordinary skill in the art of shape forming and deforming, may be used to quantify the strain. In some embodiments, the applied force may produce a von Mises strain of at least about 3%, at least about 5%, at least about 10%, at least about 25%, at least about 50%, or at least about 80%. The applied force may produce a von Mises strain of between about 3% and between about 80%, or between about 50% and about 70%.

It should be understood that the strain values described above may relate to strains produced during the application of a force in a single cycle process, or the strain produced during each application of force during a multi-cycle process.

The force may be applied (e.g., to plastically strain a metal) over any suitable period of time. In some instances, the force is applied within a range of time. For example, in some embodiments, the lower end of the range may be at least about 0.01 seconds, at least about 0.1 seconds, at least about 1 second, at least about 5 seconds, at least about 10 seconds, or at least about 1 minute while the upper end of the range may be about 10 seconds, about 1 minute, about 5 minutes, or about 10 minutes. It should be understood that the range may be bound by any suitable combination of the lower limits and upper limits described above.

The force may be applied to achieve any suitable rate of strain. For example, in some embodiments, the force may be applied to produce a rate of strain in the metal of at least about 0.01% per second, at least about 0.1% per second, at least about 1% per second, at least about 10% per second, at least about 100% per second, at least about 1000% per second, at least about 10,000% per second, or higher. In some cases, the force may be applied to achieve a rate of strain in the metal of between about 0.1% per second and about 10,000% per second, or between about 1% per second and about 1000% per second.

While maintaining the metal at an elevated temperature (e.g., above a temperature or within a temperature range), the amount of force applied to the metal may be reduced, in some embodiments. For example, the reduction in the amount of force applied may be such that the metal is no longer strained. During the period of time over which the force applied to the metal is reduced, the metal may be annealed as described above. In some embodiments, the reduction step may comprise reducing the first force by at least about 50%, at least about 75%, at least about 85%, at least about 95%, or at least about 99%. In some embodiments, the reducing step may comprise reducing the applied force to zero. In other embodiments, the reducing step may comprise reducing the applied force to a non-zero value.

After reducing the force applied to the metal, the amount of force may remain reduced over any suitable period of time. For example, in some embodiments, the amount of force applied to the metal may remain reduced for at least about 5 seconds, at least about 30 seconds, at least about 60 seconds, at least about 120 seconds, at least about 300 seconds, or at least about 600 seconds. In some cases, the amount of force applied to the metal may remain reduced for between about 5 and about 600 seconds or between about 10 and about 300 seconds.

In some embodiments, another force may be applied after the step of reducing the applied force. For example, while maintaining a metal above a temperature, a second force (or third force, etc.) may be applied to strain the metal over a period of time subsequent to the period of time over which the first force is applied and subsequently reduced. In some embodiments, the application of multiple forces to strain the metal may result in a cumulative engineering strain (or a cumulative true strain, or a cumulative von Mises strain) of at least about 3%, at least about 5%, at least about 10%, at least about 25%, at least about 50%, at least about 80%, at least about 95%, at least about 99%, or at least about 99.8%. The application of multiple forces to strain the metal may result in a cumulative engineering strain (or a cumulative true strain, or a cumulative von Mises strain) of between about 3% and about 99.8%, or between about 50% and about 95%.

In some embodiments, each step of applying a force may produce a substantially similar strain in the metal. For example, in some embodiments, each period of time over which a force is continuously applied results in an engineering strain (or a true strain, or a von Mises strain) of about 3%, about 5%, about 10%, about 25%, about 50%, about 80%, about 95%, about 99%, or about 99.8%. In other embodiments, the amount of strain produced by at least one force application step may be substantially different than the others. For example, the application of a first force may result in a first change in engineering strain, while the application of a second force may result in a substantially larger or substantially smaller engineering strain.

Each force application step in a multi-step process may also strain the metal at a similar rate. Alternatively, in other embodiments, one or more force application steps occurs at a substantially higher or substantially lower rate of strain. In addition, in some instances, the amount of time over which the applied force remains reduced may be substantially similar between each force application step of a multi-cycle process. In other instances, the amount of time over which the applied force remains reduced may be substantially longer or substantially shorter between at least two force application steps. For example, in some embodiments, the amount of time over which the force remains reduced may be substantially longer between first and second force application steps than between second and third force application steps.

One or more force application steps in a multi-step process may occur at a substantially different temperature than one or more other force application steps in a multi-step process. For example, in some embodiments, the first force application step may occur at a substantially higher temperature than at least one subsequent force application step. As another example, the first force application step can occur at a substantially lower temperature than at least one subsequent force application step.

Grain boundaries (e.g., special grain boundaries, general grain boundaries) may be characterized using Coincidence Site Lattice (CSL) theory. CSL theory distinguishes special and general grain boundaries according to the crystallographic misorientation between the two neighboring grains. According to CSL theory, sigma represents the inverse of the number density of the coincident lattice points between two misoriented crystals such as those that meet at a grain boundary. For example, a sigma value of 3 means that ⅓ of the lattice points of the two crystal grains meeting at a grain boundary coincide. As used herein, special boundaries are defined under CSL theory as those with sigma values from 1 up to and including 29, while general grain boundaries are defined as those with sigma values greater than 29. Grain boundary analysis is customarily performed by measuring the lengths of grain boundaries within a cross-section of the metal. The fraction of special grain boundaries is calculated by dividing the sum of the lengths of the special grain boundaries by the sum of the lengths of all the grain boundaries in the cross-section. This analysis may be achieved by using, for example, electron backscatter diffraction (EBSD).

EBSD analysis methods are known to those of ordinary skill in the art, and may be used to examine the crystallographic orientation of crystals in a material, which can be used to determine texture and/or orientation of crystalline or polycrystalline materials. EBSD can be conducted using a Scanning Electron Microscope (SEM) equipped with a backscatter diffraction camera. The diffraction camera can include a phosphor screen and a camera to register the image on the phosphor screen. Alternatively, a CCD detector may be used to register the image. A flat, polished crystalline specimen may be placed into position in the specimen chamber, highly tilted (e.g., about 70° from horizontal) towards the diffraction camera. When electrons impinge on the specimen, they can interact with the atomic lattice planes of the crystalline structures. Many of these interactions satisfy Bragg conditions and undergo backscatter diffraction. The angle of the specimen allows the diffracted electrons to escape the material and be detected either at the phosphor screen or on a CCD detector as a diffraction pattern. Once the diffraction pattern is acquired in this manner, it may be analyzed using methods known to those of ordinary skill in the art, to discern the orientation of the crystal from which the pattern was formed. Grain boundary characteristics, including the sigma number, may also be discerned from EBSD data, by comparing the orientations of two crystal grains that meet at a grain boundary. The methods for calculating the sigma numbers of grain boundaries from such orientation information are also known to those of ordinary skill in the art.

In some embodiments, methods may be used to produce metal articles with a relatively high fraction of special grain boundaries. For example, in some embodiments, metals and articles described herein may have special grain boundary fractions of at least about 55%, at least about 60%, at least about 65%, at least about 70%, or at least about 75%. In some embodiments, metals and articles described herein may have special grain boundary fractions of between about 55% and about 75%, or between about 65% and about 75%.

The methods described herein may be used with a wide variety of metals. The metal may be a pure metal, or an alloy. In some embodiments, the metal may be a face-centered cubic metal or alloy. For example, the metal may comprise copper (e.g., tough pitch copper (e.g., at least 99.99 wt % copper, several hundred ppm of oxygen, and impurities), low-oxygen copper (e.g., ≤20 ppm oxygen), oxygen-free copper (e.g., ≤10 ppm oxygen), highly-pure oxygen-free copper (e.g., at least 99.9999% copper, <1 ppm oxygen, and impurities), etc.), a copper alloy (brass, phosphorous copper, etc.), nickel (e.g., commercially pure nickel (e.g., ≥99.9 wt % nickel)), a nickel alloy, iron, or a steel (e.g., austenitic stainless steel, etc.). In some embodiments, the metal may be substantially free of oxygen (e.g., oxygen impurities, oxidized metal, etc.). For example, in some cases, the metal may be commercially pure metal that is substantially free of oxygen. In some embodiments, the metal may comprise a face-centered cubic metal with a relatively low stacking fault energy (e.g., a stacking fault energy of less than about 100 $mJ/m^2$). In some embodiments, the metal may comprise a two-phase or a multi-phase system in which one phase is face-centered cubic, or in which one phase is face-centered cubic and has a stacking fault energy of less than about 100 $mJ/m^2$. For example, some steels may comprise both face-centered and body-centered cubic phases, and some copper alloys may contain precipitates of a second phase that is not face-centered cubic.

The following examples are intended to illustrate certain embodiments of the present invention, but are not to be construed as limiting and do not exemplify the full scope of the invention.

EXAMPLE 1

In this example, a variety of metal samples were processed according to techniques described herein. The processing included subjecting the samples to one or more cycles of applied force(s) to strain the samples.

Five types of base FCC materials (4 copper-based materials, and one nickel-based material) were tested. Tough pitch copper (TPC) includes at least 99.99 wt % copper, several hundred ppm of oxygen, and impurities. Oxygen-free copper (OFC) includes at least 99.99 wt % copper, less than or equal to 10 ppm of oxygen, and impurities. Phosphorous deoxidized copper (PDC) includes at least 99.98 wt % copper about 80 ppm phosphorous, and less than or equal to 10 ppm of oxygen. Highly-pure oxygen-free copper (HOFC) includes at least 99.9999% copper, less than 1 ppm oxygen, and impurities. The fifth type of sample used was commercially pure nickel, which included at least 99.9 wt % nickel and impurities.

To begin, 12 samples of material were cut to form rectangular pieces measuring approximately 9 mm×9 mm×10 mm. The types of materials and process parameters for each of the 12 samples are outlined in Table 1. The cut samples were preheated in air at their processing temperatures (outlined in Table 1) for 1 hour. In the case of Sample 2, the material was pre-heated to a temperature of 0.46 $T_m$ (about 350° C.).

After preheating, one or more cycles of force were applied to deform the samples at their processing temperatures. In this example the deformation was compressive, and the applied force that of uniaxial compression. Table 1 includes the amounts of engineering strain per cycle as a measure of the deformation, and the rates of strain for each of the tested samples. For example, Sample 2 was strained at a rate of 0.017 $s^{-1}$ (i.e., the sample was reduced in height by 1.7%, relative to its height at the start of the cycle, each second) until the engineering strain reached 17% (about 10 s) for this cycle.

After the prescribed time elapsed for applying the force, the force on the material was reduced to zero and the samples were maintained at the processing temperature for an "intermediate time," as indicated in Table 1. During this time, the samples were annealed. In some cases, subsequent cycles of applying and reducing force were used. Table 1 includes a list of the number of cycles for each of the materials (e.g., 5 cycles for Sample 2). After the final cycle, the sample was quenched to room temperature.

Each strained sample was cut through its middle. The cut samples were first mechanically polished using emery paper. Samples were subsequently polished using a diamond suspension, followed by a colloidal silica suspension polish for at least 30 minutes. Finally, the samples were electropolished to remove the surface deformation regions.

Grain orientation data was acquired using EBSD (TSL/EDAX Digiview) attached to a Field Emission Scanning Electron Microscope (FE-SEM) (Zeiss Supra55) using OIM™ Data Collection Version 5 (TSL/EDAX) software. The scan conditions were as follows: total scan area of 750×750 microns, ×300 magnification, and a scan step of 3 microns. The edge regions of the 750×750 micron scans were trimmed to 740×740 microns by eliminating all data within 5 microns of the scan edge, as these regions frequently contained inaccurate data due to beam control issues during data acquisition.

The data was appropriately cleaned up using the software to eliminate inaccurate data points during data acquisition process (e.g. corresponding to a partially rough surface or contamination particles on the surface).

Figure 2:
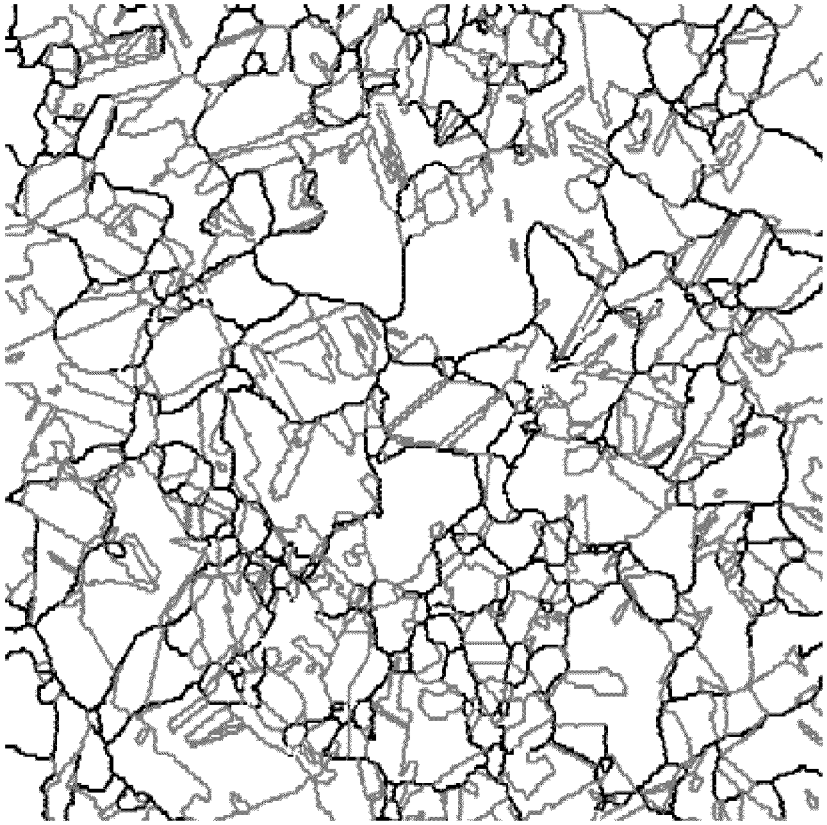
FIG. 2 is an exemplary image outlining special grain boundaries in Sample 8 of Example 1.

The cleaned orientation data was analyzed to determine the percentage of special grain boundaries in each sample using the OIM™ Data Analysis Version 5 software. Grain boundaries were defined as boundaries whose misorientation between 2 neighboring points was more than 15 degrees. Each grain boundary was classified as either "special" (sigma between 1 and 29) or "general" (sigma greater than 29). The percentages of "special" grain boundaries were calculated by dividing the total length of the special grain boundaries by the total length of all of the grain boundaries (both special and general), and multiplying by 100%. FIG. 1 includes an image of the general grain boundaries (shown in black) and special grain boundaries (shown in gray) in Sample 1 of this example. FIG. 2 includes an image of the general grain boundaries (black) and special grain boundaries (gray) in Sample 8 in this example.

TABLE 1

Experimental results for samples tested in Example 1

| Sample | Material | Process Temp. | Eng. Strain per cycle | Rate of Strain ($s^{-1}$) | Intermediate Time (s) | Number of Strain Cycles | % of Special Grain Boundaries | Grain Size (μm) |
|---|---|---|---|---|---|---|---|---|
| 1 | HOFC | 0.42 $T_m$ | 17% | 0.017 | 60 | 5 | 64% | 33 |
| 2 | HOFC | 0.46 $T_m$ | 17% | 0.017 | 60 | 5 | 71% | 32 |
| 3 | TPC | 0.50 $T_m$ | 65% | 0.017 | 45 | 1 | 65% | 18 |
| 4 | HOFC | 0.53 $T_m$ | 17% | 0.017 | 60 | 5 | 69% | 42 |
| 5 | OFC | 0.57 $T_m$ | 6% | 0.017 | 10 | 10 | 62% | 19 |
| 6 | OFC | 0.61 $T_m$ | 17% | 0.017 | 60 | 3 | 66% | 31 |
| 7 | OFC | 0.61 $T_m$ | 50% | 0.017 | 10 | 1 | 65% | 29 |
| 8 | OFC | 0.61 $T_m$ | 50% | 0.17 | 20 | 1 | 64% | 24 |
| 9 | PDC | 0.61 $T_m$ | 17% | 0.017 | 60 | 5 | 63% | 21 |
| 10 | HOFC | 0.64 $T_m$ | 65% | 0.85 | 10 | 1 | 66% | 30 |
| 11 | HOFC | 0.64 $T_m$ | 65% | 0.017 | 60 | 5 | 64% | 66 |
| 12 | Ni | 0.59 $T_m$ | 65% | 0.015 | 60 | 3 | 62% | 41 |

COMPARATIVE EXAMPLE 2

Figure 3:
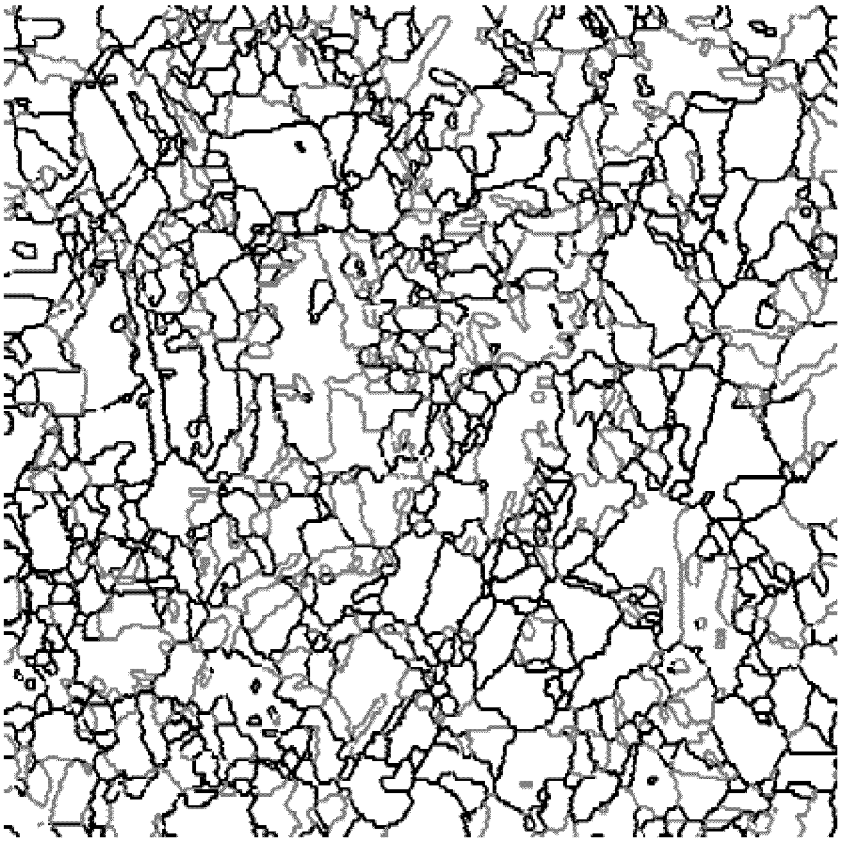
FIG. 3 includes an exemplary image outlining special grain boundaries for the sample in Comparative Example 2.

In this comparative example, a commercial oxygen-free copper plate was analyzed. The plate, which was not subject to mechanical processing, was analyzed using the same methods outlined in Example 1. As shown in Table 2 (CE2), the percentage of special grain boundaries in this sample (33%) was substantially lower than those outlined in Example 1. FIG. 3 includes an image outlining the general grain boundaries (black) and special grain boundaries (gray) for the sample (CE2) in this example.

TABLE 2

Experimental results for sample tested in Comparative Example 2

| Sample | Material | Deform Temp. | Anneal Temp. | Strain per cycle | Rate of Strain ($s^{-1}$) | Intermediate Time (s) | Number of Strain Cycles | % of Special Grain Boundaries | Grain Size (μm) |
|---|---|---|---|---|---|---|---|---|---|
| CE2 | Comm. OFC | — | — | — | — | — | — | 33% | 21 |

What is claimed is:

1. A method of processing a metal, comprising:

while maintaining the metal at a temperature suitable to anneal the metal:

applying a force to strain the metal over a first period of time; and reducing the applied force over a second period of time subsequent to the first period of time;

wherein the metal is processed to have a special grain boundary fraction of at least about 55%.

2. A method as in claim 1, further comprising, while maintaining the metal at a temperature suitable to anneal the metal, applying a second force to strain the metal over a third period of time subsequent to the first and second periods of time, and reducing the applied second force over a fourth period of time subsequent to the third period of time.

3. A method as in claim 2, wherein the first force is applied at a first temperature and the second force is applied at a second temperature, and the first and second temperatures are substantially different.

4. A method as in claim 3, wherein the first temperature is higher than the second temperature.

5. A method as in claim 2, wherein the applied force produces a cumulative engineering strain of at least about 10%.

6. A method as in claim 2, wherein the applied force produces a cumulative engineering strain of at least about 50%.

7. A method as in claim 1, further comprising additional cycles of applying force to strain the metal and reducing force.

8. A method as in claim 1, wherein the temperature is above about 0.4 $T_m$ expressed in Kelvins.

9. A method as in claim 1, wherein the temperature at which recrystallization of the metal occurs is between about 0.4 $T_m$ expressed in Kelvins and 0.75 $T_m$ expressed in Kelvins.

10. A method as in claim 1, further comprising heating the metal above the temperature prior to maintaining the metal above the temperature.

11. A method as in claim 1, wherein the metal is processed to have a special grain boundary fraction of at least about 60%.

12. A method as in claim 1, wherein the metal is processed to have a special grain boundary fraction of at least about 65%.

13. A method as in claim 1, wherein the reducing step comprises reducing the applied force to zero.

14. A method as in claim 1, wherein the reducing step comprises reducing the applied force to a non-zero value.

15. A method as in claim 1, wherein the applied force produces an engineering strain of at least about 3%.

16. A method as in claim 1, wherein the applied force produces an engineering strain of at least about 10%.

17. A method as in claim 1, wherein the applied force produces a von Mises strain of at least about 3%.

18. A method as in claim 1, wherein the applied force produces a von Mises strain of at least about 10%.

19. A method as in claim 1, wherein the applied force produces a rate of strain of at least about 0.01% per second.

20. A method as in claim 1, wherein the first period of time is at least about 0.01 seconds.

21. A method as in claim 1, wherein the second period of time is at least about 0.01 seconds.

22. A method as in claim 1, wherein the metal comprises nickel.

23. A method as in claim 1, wherein the metal comprises copper.

24. A method as in claim 1, wherein the metal comprises a copper alloy, a nickel alloy, and/or a steel.

25. A method as in claim 1, wherein the metal is substantially free of oxygen.

26. A method as in claim 1, wherein the metal comprises a face-centered cubic metal with a stacking fault energy of less than about 100 $mJ/m^2$.

27. A method as in claim 1, wherein the metal is processed to have a special grain boundary fraction of at least about 55% without substantially heating the metal after the force application step.

28. A method as in claim 1, wherein the first period of time is at least about 1 second.

* * * * *